US005915573A

United States Patent [19]

Drower et al.

[11] Patent Number: 5,915,573

[45] **Date of Patent: *Jun. 29, 1999**

[54] STORAGE RACK WITH GRIPPING CHANNEL FOR SUPPORT LOOPS

[75] Inventors: Herbert M. Drower, Wilmette, Ill.; Dean S. Paris, Takoma Park, Md.

[73] Assignee: Transilwrap Company, Inc., Chicago, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/823,157

[22] Filed: Mar. 25, 1997

[51] Int. Cl.[6] ..... A47F 5/00

[52] U.S. Cl. ..... 211/89.01; 211/70.6; 211/94.01; 211/120

[58] Field of Search ..... 211/94.01, 89.01, 211/120, 70.6

[56] References Cited

U.S. PATENT DOCUMENTS

| | | | |
|---|---|---|---|
| 2,430,624 | 11/1947 | Vollmer | 211/120 |
| 2,975,949 | 3/1961 | Lutsky | 211/94.01 X |
| 3,363,340 | 1/1968 | McKinley | 211/182 X |
| 3,388,809 | 6/1968 | Irish | 211/182 X |
| 4,936,469 | 6/1990 | Drower . | |
| 5,419,443 | 5/1995 | Niederberger et al. | 211/89.01 X |
| 5,570,794 | 11/1996 | Drower | 211/120 X |

*Primary Examiner*—Robert W. Gibson, Jr.
*Attorney, Agent, or Firm*—Dorn, McEachran, Jambor & Keating

[57] ABSTRACT

A storage rack for small articles including an elongated housing having a back wall, a front wall and top and bottom walls. An elongated opening is formed in the front wall of the housing. The elongated opening is defined by inwardly extending portions of the front wall thereby forming hooks. A multiplicity of retainer loops formed of a strip of a tough, resilient, abrasive-resistant resin is provided for the storage rack. Each retainer loop has a bight portion positioned outwardly of the front wall of the housing and two legs extending through the elongated opening to position the distal ends of the loop inside the housing. A pair of hook engaging notches are formed in the distal end of each of the legs. The hook engaging notches receive the opening defining hooks of the housing to preclude withdrawal of the retainer loops through said elongated opening. In one embodiment the inwardly extending portions of the front wall defining the opening extend parallel to the top and bottom walls of the housing while in the other embodiment of the invention the inwardly extending portions are reversely curved.

3 Claims, 2 Drawing Sheets

STORAGE RACK WITH GRIPPING CHANNEL FOR SUPPORT LOOPS

BACKGROUND OF THE INVENTION

Storage racks for small articles, ranging from pencils and pens to other items such as paint brushes, cassettes, computer floppy disks and small containers are available in many sizes, styles, constructions and configurations. Previously known storage racks using plastic support loops required complicated constructions of the racks and formation of the ends of the plastic support loops to maintain the plastic support loops against unintentional pull out of these loops.

SUMMARY OF THE INVENTION

It is a principal object of the present invention, therefore, to provide a new and improved storage rack for small articles and things utilizing plastic loops which racks and loops are relatively simple to manufacture but resist unintentional pull out of the plastic support loops.

Accordingly, the invention relates to a storage rack for small articles including an elongated housing having a back wall, a front wall and top and bottom walls. An elongated opening is formed in the front wall of the housing. The elongated opening is defined by inwardly extending portions of the front wall with these portions cooperating with the front wall to form hooks. A multiplicity of retainer loops are formed of a strip of a tough, resilient, abrasive-resistant resin. Each retainer loop is formed with a bight portion positioned outwardly of the front wall of the housing and two legs extending through the elongated opening to position their distal ends inside the housing. A pair of hook engaging notches are formed in the distal end of each of the legs. The hook engaging notches of the retainer loops receive the opening defining hooks of the elongated housing to preclude withdrawal of the retainer loops through the elongated opening in the front wall of the housing. In one embodiment, the inwardly extending portions of the front wall of the housing extend parallel to the top and bottom walls of the housing while in the other embodiment the inwardly extending portions of the front wall of the housing which define the opening in the housing are each reversely curved.

BRIEF DESCRIPTION OF THE DRAWINGS

The invention is illustrated more or less diagrammatically in the following drawings wherein.

DESCRIPTION OF THE PREFERRED EMBODIMENTS

Figure 1:
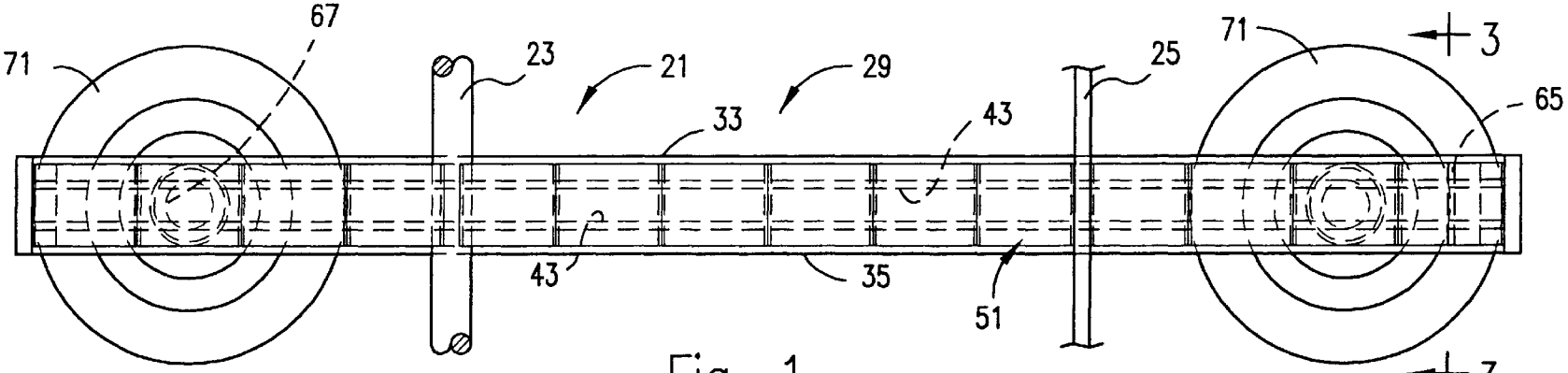
FIG. 1 is a front elevational view of a storage rack for small articles constructed in accordance with one embodiment of the present invention with hidden parts shown by dashed lines and portions of the articles being supported broken away for compactness of illustration.
Figure 2:
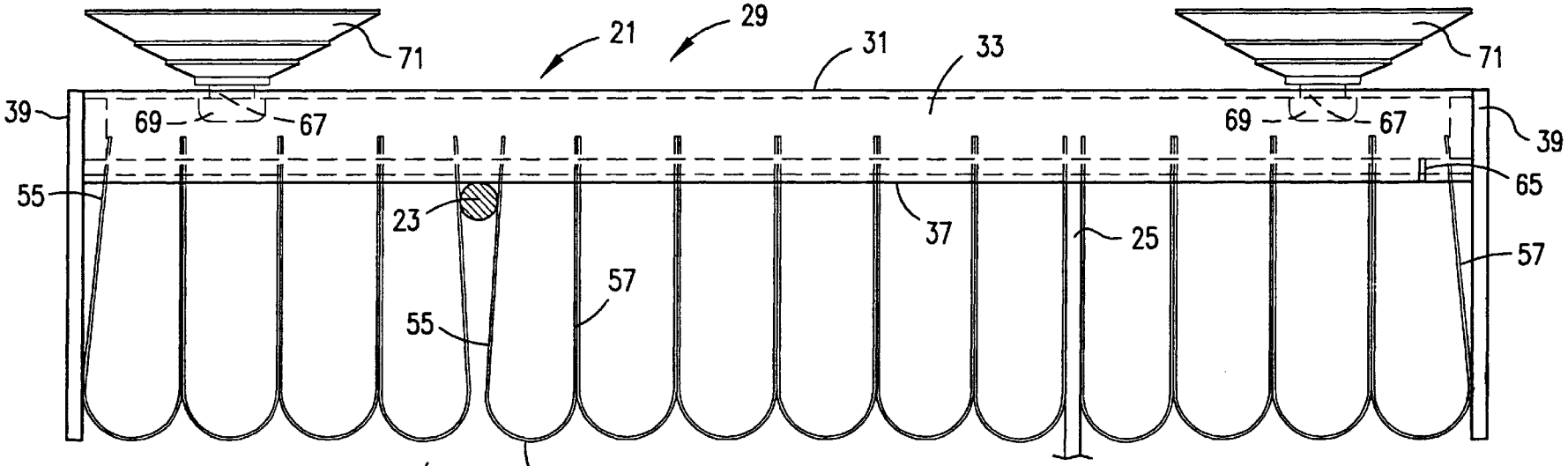
FIG. 2 is a top plan view of the storage rack of FIG. 1 with hidden parts shown by dashed lines.
Figure 3:
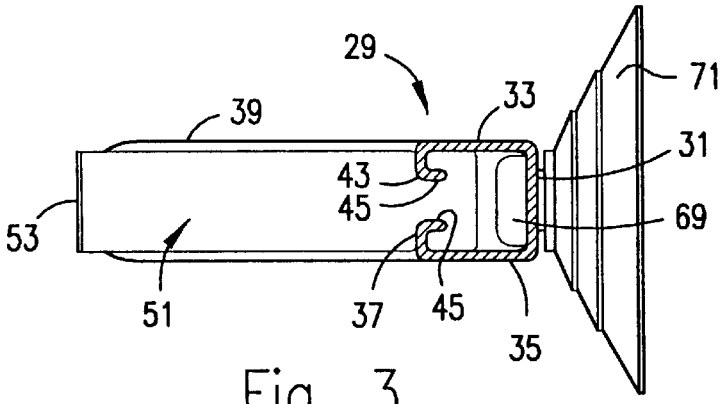
FIG. 3 is a cross sectional view taken along line 3—3 of FIG. 1.

FIGS. 1–3 and 5 of the drawings illustrate one embodiment of a storage rack 21 for storing small articles, constructed in accordance with the teachings of the present invention. As is most clearly shown in FIGS. 1 and 2, the rack 21 may be used for the storage of a variety of small articles of varying sizes, shapes and descriptions. Specifically, for purposes of illustration and not by way of limitation, a pencil 23 and a computer disk 25 are shown supported on the rack. It should be understood and appreciated that other articles such as measuring tapes, chalk, putty knives, erasers, paint brushes, cassettes, etc, may also be stored in such a rack.

The rack 21 includes a housing 29 which is elongated and is formed with a rear wall 31 which is adapted to be positioned adjacent a supporting surface such as a wall, partition, etc., which is not shown in the drawings for clarity of illustration. The elongated housing 29 is also formed with top and bottom walls 33 and 35, respectively and a front wall 37. End walls 39 join the rear, top, bottom and front walls to complete the housing 29. The end walls extend well forwardly of the front wall 37 as can be seen most clearly in FIGS. 1 and 2 of the drawings to provide lateral support for the retainer loops which will be hereinafter described. An elongated opening 43 is formed in the front wall 37 and extends substantially the length of the housing 29. This opening is defined by inwardly bent portions 45 of the front wall which extend parallel to the top and bottom walls 33 and 35 respectively to effectively form hooks. The storage rack housing 29 may be formed of any suitable material such as metal or plastic although plastic is preferred because of its light weight, low cost and ease of forming.

The storage rack 21 further includes a multiplicity of retainer loops 51. Each retainer loop 51 is formed of a strip of a tough, resilient, abrasive-resistant resin, preferably a polyester resin or laminate. The preferred construction for each retainer loop is two layers of oriented polyethylene terephthalate laminated with a central layer of polyethylene, the same basic construction as is used in commercial identification cards and similar articles.

Each retainer loop 51 is formed with a bight portion 53 joining a pair of legs 55 and 57. A pair of L-shaped notches 61 are formed near the distal end of each leg 55,57 with the base leg of each L-shaped notch extending towards the distal end of its leg. The notches may be formed by stamping, cutting or in any conventional manner suitable for forming a notch in a laminate strip of plastic. The notches are complementary in shape to the inwardly extending portions 45 of the front wall 37 of the housing 29 being only slightly larger so as to be tightly received by the hook portions of the front wall as can be most clearly seen in FIG. 3 of the drawings.

The retainer loops 51 may be installed on the elongated housing 29 before the end walls 39 are installed on the housing. Additionally, to facilitate the ease of installation of retainer loops, a retainer loop insertion slot 65 is formed in the front wall 37 of the housing 29 and extends through the inwardly extending portions 45 thereof as is most clearly shown in FIGS. 1 and 2 of the drawings.

Circular passages 67 are formed in the rear wall 31 of the storage rack housing 29 near opposite ends thereof to receive the heads 69 of suction cups 71 to support the storage rack on a wall or other support surface. The circular passages 67 may also be used to receive nails or screws to fasten the storage rack to a supporting surface or a double sided adhesive tape may also be used but these alternative means of support are not shown in the drawings for clarity of illustration.

Figure 4:
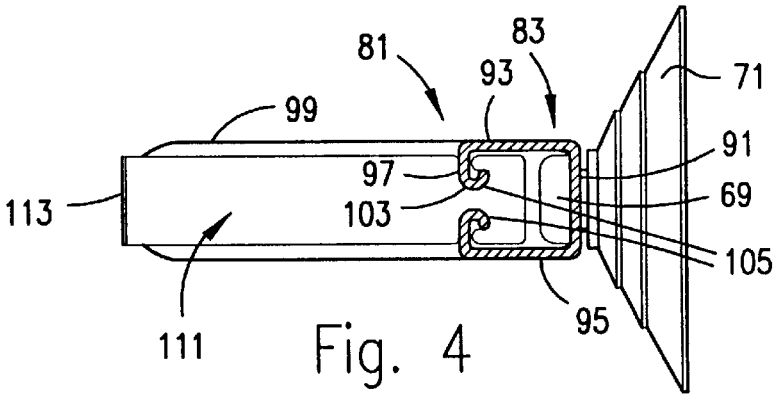
FIG. 4 is a cross sectional view similar to FIG. 3 but showing a second embodiment of the invention.
Figure 5:
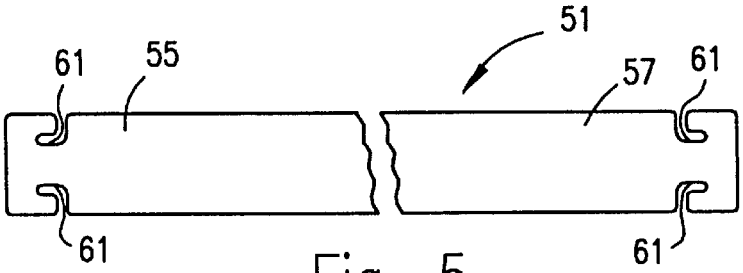
FIG. 5 is a plan view of a flattened retainer loop of the embodiment shown in FIGS. 1, 2 and 3 of the drawings.
Figure 6:
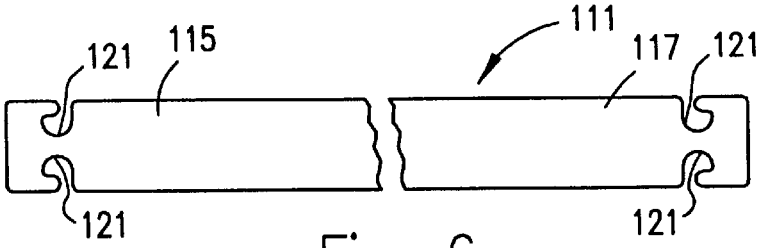
FIG. 6 is a plan view of a flattened retainer loop of a modified embodiment of the invention as shown in FIG. 4 of the drawings.

FIGS. 4 and 6 of the drawings show another embodiment of the invention incorporated into a storage rack 81 which is similar to storage rack 21 and includes an elongated housing 83 having a rear wall 91, top wall 93, bottom wall 95, a front wall 97 and end walls 99. An elongated opening 103 is formed in the front wall 97 and extends substantially the length of the housing 83. This elongated opening is defined by inwardly extending portions 105 of the front wall 97 which are reversely curved as can be seen most clearly in FIG. 4 of the drawings.

The storage rack 81 includes a multiplicity of retainer loops 111 which are formed of the same material as used for retainer loops 51 which have been previously described. Each retainer loop has a bight portion 113 joining a pair of legs 115 and 117. A pair of semi-circular notches 121 are formed in each leg near its distal end as can be most clearly seen in FIG. 6 of the drawings. These notches may be formed in the same manner as the notches 61 previously described for the first embodiment of this invention. The notches 121 are slightly larger than the inwardly extending reversely curved portions 105 so that they will receive the inwardly curved portions 105 when the retaining loops 111 are installed in the elongated housing 83 as shown most clearly in FIG. 4 of the drawings.

We claim:

1. A storage rack for small articles, including:

an elongated housing having a back wall, a front wall and top and bottom walls, an elongated opening formed in said front wall of said elongated housing, said elongated opening being defined by inwardly and rearwardly extending portions of said front wall forming hooks, a multiplicity of retainer loops formed of a strip of a tough, resilient, abrasive-resistant resin, each retainer loop having a bight portion positioned outwardly of said front wall of said elongated housing and two legs extending through said elongated opening in said front wall to position the distal ends of each retainer loop inside said elongated housing, and a hook engaging notch formed in the distal end of each of said legs of said retainer loops, said hook engaging notches each having an inwardly extending notch portion and a rearwardly extending notch portion adapted to receive said hooks to preclude withdrawal of the retainer loops through said elongated opening.

2. The storage rack of claim 1 in which said rearwardly extending portions of said front wall extend parallel to said top and bottom walls of said elongated housing.

3. The storage rack of claim 1 in which said inwardly and rearwardly extending portions of said front wall of said elongated housing are reversely curved.

* * * * *